US010772419B2

(12) United States Patent
McArdle

(10) Patent No.: US 10,772,419 B2
(45) Date of Patent: Sep. 15, 2020

(54) CLEANING ASSEMBLY

(71) Applicant: Michael McArdle, Parlin, NJ (US)

(72) Inventor: Michael McArdle, Parlin, NJ (US)

( * ) Notice: Subject to any disclaimer, the term of this patent is extended or adjusted under 35 U.S.C. 154(b) by 29 days.

(21) Appl. No.: 15/949,127

(22) Filed: Apr. 10, 2018

(65) Prior Publication Data

US 2019/0307239 A1 Oct. 10, 2019

(51) Int. Cl.
*A46B 11/06* (2006.01)
*A46B 9/02* (2006.01)
*A46B 11/00* (2006.01)

(52) U.S. Cl.
CPC ..... *A46B 11/066* (2013.01); *A46B 9/026* (2013.01); *A46B 11/0024* (2013.01); *A46B 11/063* (2013.01); *A46B 2200/3013* (2013.01)

(58) Field of Classification Search
CPC ..... A46B 11/063; A46B 11/066
USPC ..... 401/289
See application file for complete search history.

(56) References Cited

U.S. PATENT DOCUMENTS 2,800,313 A * 7/1957 Targosh ..... A46B 11/066 15/29
3,989,388 A * 11/1976 Sparr, Sr. ..... A46B 9/02 401/11
4,709,717 A 12/1987 Rannigan
4,836,702 A 6/1989 Allen
D340,327 S 10/1993 Alderete
5,285,968 A 2/1994 McSheehy
6,270,278 B1 8/2001 Mauro
6,715,501 B2 * 4/2004 Pociask ..... B08B 3/026 134/138
9,061,299 B1 6/2015 Fodor
10,052,656 B2 * 8/2018 Maslennikov ..... B05D 1/28
2006/0086381 A1 4/2006 Bardini
2015/0064357 A1 * 3/2015 Tomuta ..... A46B 11/063 427/429

* cited by examiner

*Primary Examiner* — Jennifer C Chiang

(57) ABSTRACT

A cleaning assembly for elongated articles includes a housing. A channel extends from a top to a bottom of the housing. A plurality of holes is positioned in the housing and extends annularly around an inner perimeter of the housing. Each hole extends to an interior space of the housing. A pipe, which is coupled to and extends from an outer perimeter of the housing, is in fluidic communication with the interior space. A hose connector that is coupled to the pipe distal from the housing is configured to couple the pipe to a hose. A reservoir is coupled to the pipe proximate to the housing. A tube extends between the reservoir and the pipe so that a cleaning agent in the reservoir is positioned to enter the pipe. Water from the hose and the cleaning agent exit the holes under pressure to clean an article positioned in the channel.

14 Claims, 5 Drawing Sheets

CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning assemblies and more particularly pertains to a new cleaning assembly for elongated articles.

BRIEF SUMMARY OF THE INVENTION

An embodiment of the disclosure meets the needs presented above by generally comprising a housing. A channel extends from a top to a bottom of the housing. A plurality of holes is positioned in the housing and extends annularly around an inner perimeter of the housing. Each hole extends to an interior space of the housing. A pipe, which is coupled to and extends from an outer perimeter of the housing, is in fluidic communication with the interior space. A hose connector that is coupled to the pipe distal from the housing is configured to couple the pipe to a hose. A reservoir is coupled to the pipe proximate to the housing. A tube extends between the reservoir and the pipe so that a cleaning agent in the reservoir is positioned to enter the pipe. Water from the hose and the cleaning agent exit the holes under pressure to clean an article positioned in the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
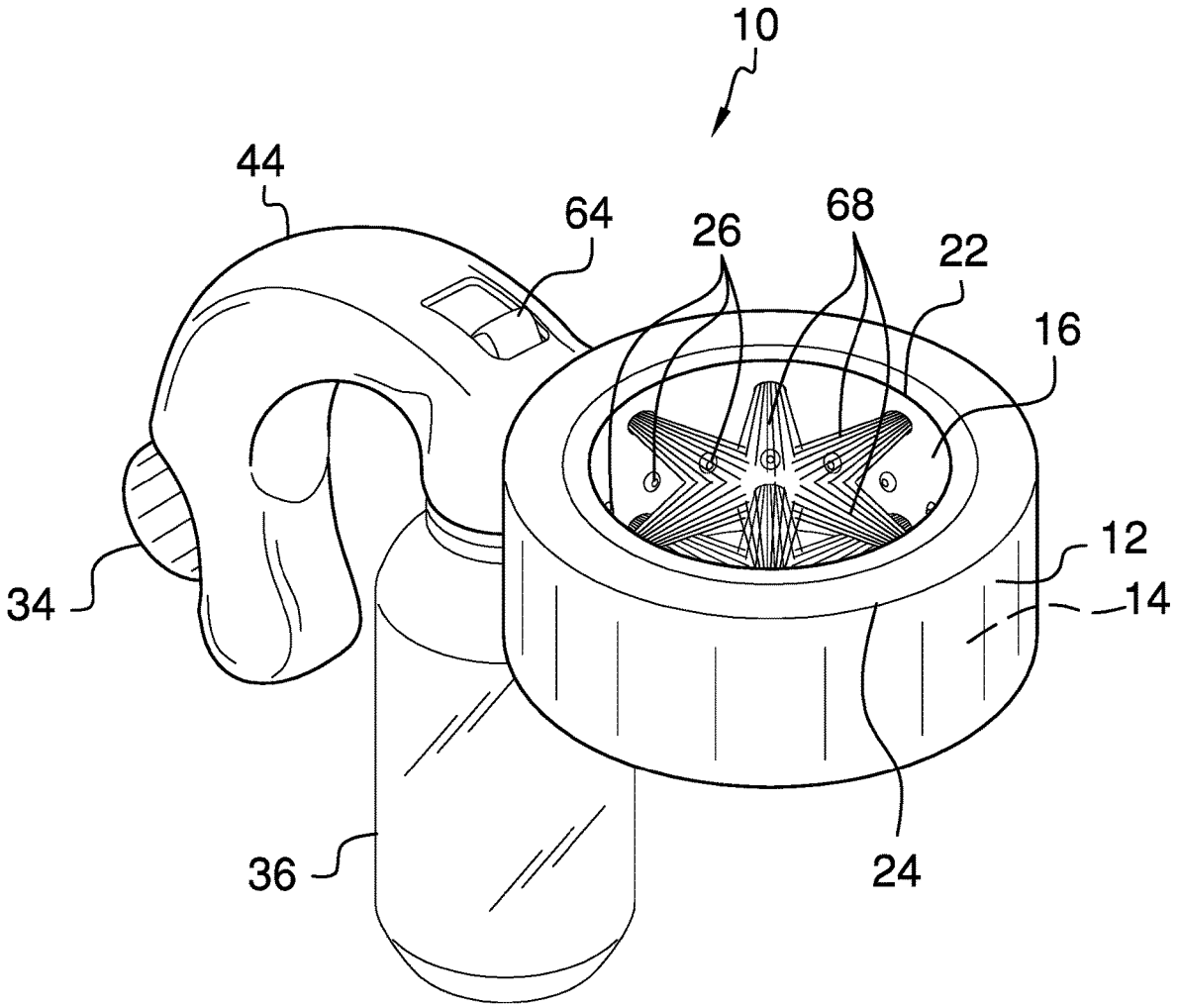
FIG. 1 is an isometric perspective view of a cleaning assembly according to an embodiment of the disclosure.

With reference now to the drawings, and in particular to FIGS. 1 through 6 thereof, a new cleaning assembly embodying the principles and concepts of an embodiment of the disclosure and generally designated by the reference numeral 10 will be described.

As best illustrated in FIGS. 1 through 6, the cleaning assembly 10 generally comprises a housing 12 that defines an interior space 14. A channel 16 extends from a top 18 to a bottom 20 of the housing 12 and defines an inner perimeter 22 and an outer perimeter 24 of the housing 12.

A plurality of holes 26 is positioned in the housing 12, as shown in FIG. 1. Each hole 26 extends to the interior space 14. The plurality of holes 26 extends annularly around the inner perimeter 22. The holes 26 are positioned substantially equally distant from the top 18 and the bottom 20 of the housing 12.

A pipe 28 is coupled to and extends from the outer perimeter 24 so that the pipe 28 is in fluidic communication with the interior space 14. The pipe 28 extends arcuately from the housing 12.

Figure 5:
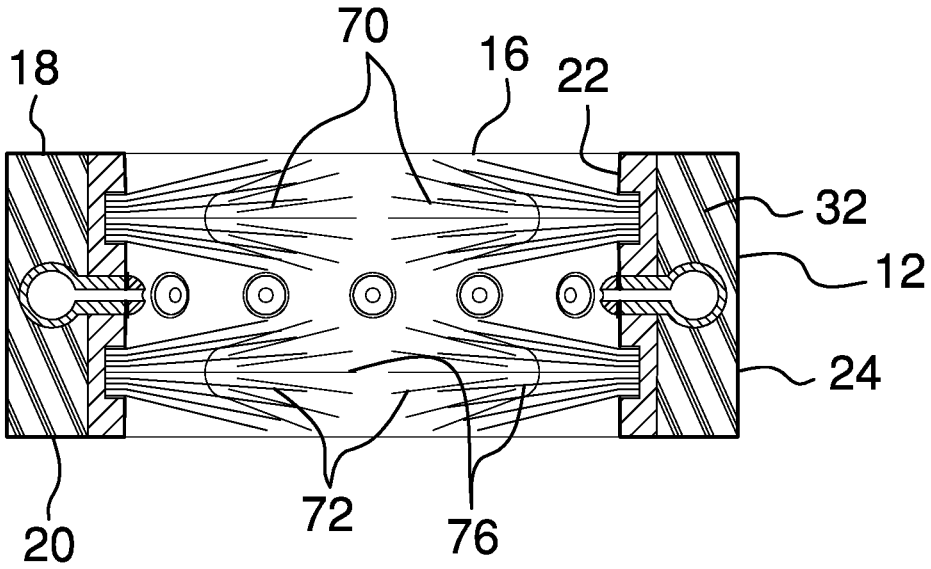
FIG. 5 is a cross-sectional view of an embodiment of the disclosure.

An annular pipe 30 is positioned in the interior space 14, as shown in FIG. 5. The annular pipe 30 extends around the channel 16. The annular pipe 30 is fluidically coupled to the pipe 28 and each of the plurality of holes 26. A filler 32 is positioned around the annular pipe 30 in the interior space 14 so that the housing 12 is substantially solid.

A hose connector 34 is coupled to the pipe 28 distal from the housing 12, as shown in FIG. 1. The hose connector 34 is configured to couple the pipe 28 to a hose to supply water through the pipe 28 to the interior space 14. The water exits the holes 26 under pressure.

A reservoir 36 is coupled to the pipe 28 proximate to the housing 12, as shown in FIG. 1. The reservoir 36 has an upper end 38 that is externally threaded. A tube 40 extends between the reservoir 36 and the pipe 28. A cleaning agent that is positioned in the reservoir 36 is positioned to enter the pipe 28. The water and the cleaning agent exit the holes 26 under pressure to clean an article that is selectively positioned in the channel 16. The user cleans the article by motivating the housing 12 along a length of the article, as shown in FIG. 2.

Figure 2:
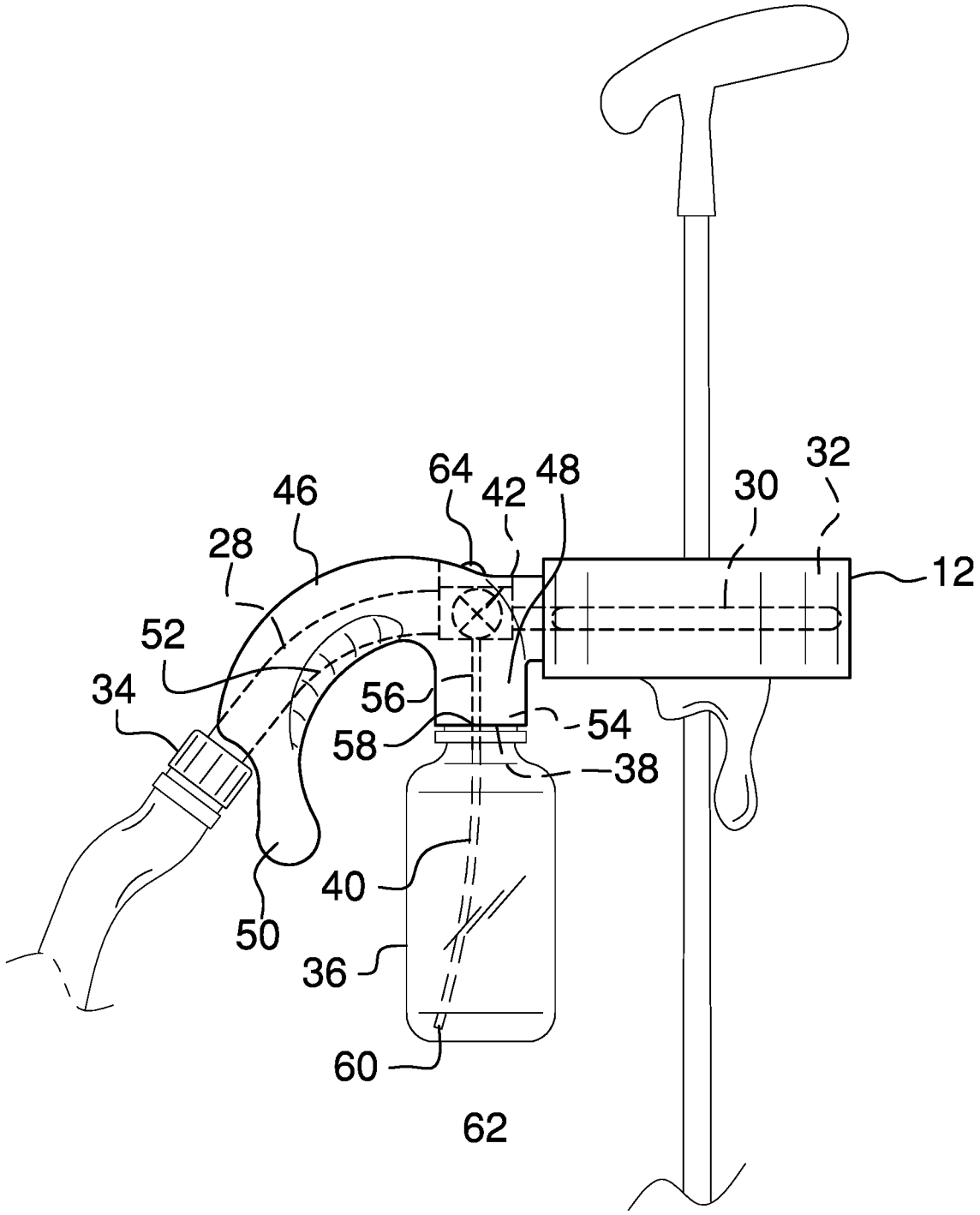
FIG. 2 is an in-use view of an embodiment of the disclosure.

A valve 42 is coupled to and is positioned in the pipe 28 proximate to the housing 12 as shown in FIG. 2. A handle 44 is positioned around and is coupled to the pipe 28 as shown in FIG. 2. The handle 44 is configured to be grasped in a hand of the user and is substantially C-shaped. The pipe 28 is positioned in a medial section 46 of the handle 44. A first section 48 of the handle 44 extends substantially perpendicularly from the pipe 28 proximate to the valve 42. A second section 50 of the handle 44 extends transversely from the pipe 28 proximate to the hose connector 34. The second section 50 is substantially tear-drop shaped.

A grip 52 is coupled to the medial section 46 of the handle 44. The grip 52 is configured to deter slippage of the hand of the user grasping the handle 44.

A recess 54 extends into the first section 48 of the handle 44 distal from the pipe 28. The recess 54 is internally threaded. The recess 54 is complementary to the upper end 38 of the reservoir 36 so that the upper end 38 is positioned to be threadedly inserted into the recess 54 to couple the reservoir 36 to the handle 44. A tubular void 56 extends from the recess 54 to the valve 42 so that the valve 42 is in fluidic communication with the recess 54, as shown in FIG. 2. The tube 40 is positioned to be inserted into the tubular void 56 to fluidically couple the tube 40 to the valve 42. The tube 40 has a first end 58 that is operationally coupled to the valve 42. The tube 40 has a second end 60 that is positioned proximate to a lower end 62 of the reservoir 36.

A controller 64 is coupled to the handle 44. The controller 64 is operationally coupled to the valve 42 so that the controller 64 is positioned to selectively actuate the valve 42 to regulate a flow of water through the pipe 28 and a rate of addition of the cleaning agent to the water that flows though the valve 42.

Figure 3:
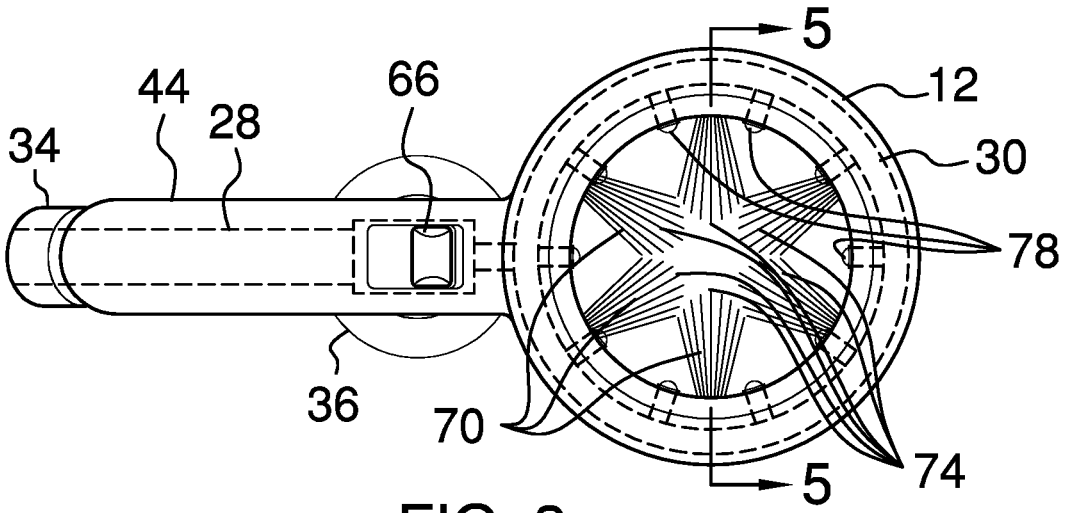
FIG. 3 is a top view of an embodiment of the disclosure.
Figure 4:
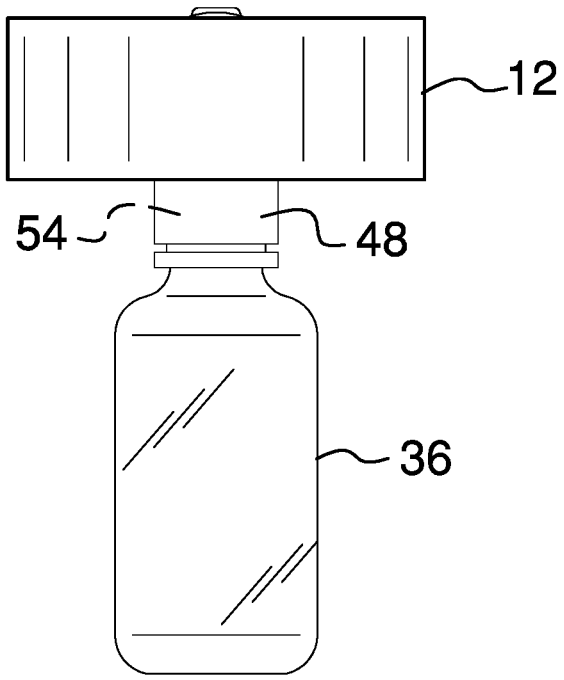
FIG. 4 is a front view of an embodiment of the disclosure.

The controller 64 comprises a slide switch 66, as shown in FIG. 3. The slide switch 66 is configured to be selectively slid relative to the handle 44 by a digit of the hand of the user that is grasping the handle 44 to regulate the flow of water through the pipe 28 and the rate of addition of the cleaning agent to the water flowing though the valve 42.

A plurality of bristles 68 is coupled to the inner perimeter 22 of the housing 12 and extends into the channel 16, as shown in FIG. 3. The bristles 68 are configured to dislodge particles that are adhered to the article that is positioned in the channel 16 as the user motivates the housing 12 along the length of the article.

The plurality of bristles 68 comprises a set of first fibers 70 and a set of second fibers 72. The set of first fibers 70 is positioned between the plurality of holes 26 and the top 18 of the housing 12. The set of first fibers 70 is positioned in six first groups 74 that are evenly space around the inner perimeter 22. The set of second fibers 72 is positioned between the plurality of holes 26 and the bottom 20 of the housing 12. The set of second fibers 72 is positioned in six second groups 76 that are evenly space around the inner perimeter 22. The second groups 76 are aligned with the first groups 74 when viewed from the top 18 of the housing 12.

Each of a plurality of nozzles 78 is coupled to the housing 12 and extends from an associated hole 26 into the channel 16. The nozzles 78 are configured to increase a velocity of the water that exits the holes 26.

Figure 6:
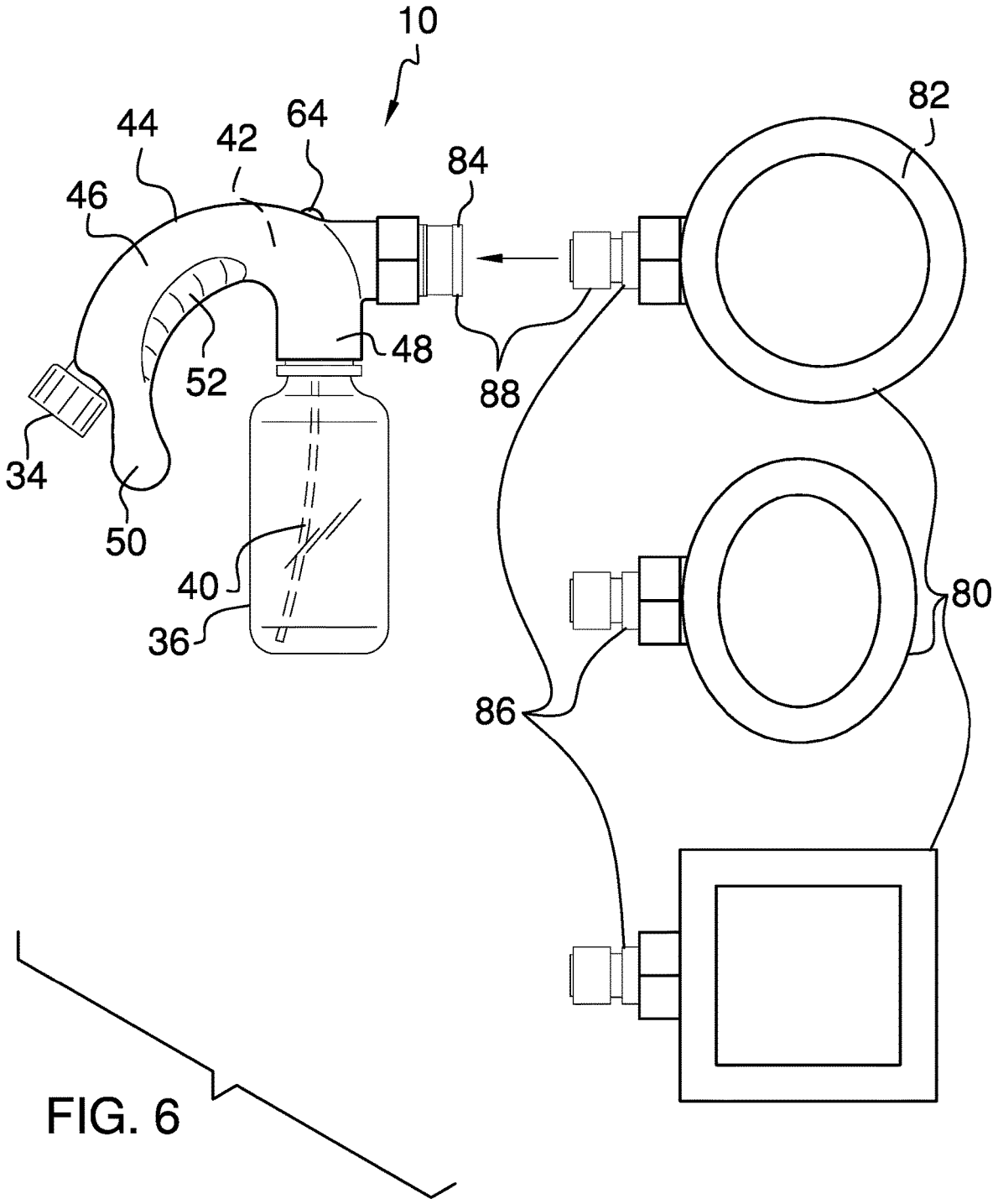
FIG. 6 is an exploded view of an embodiment of the disclosure.

In another embodiment of the invention, as shown in FIG. 6, the housing 12 comprises a plurality of shells 80. Each shell 80 defines an internal space 82. Each shell 80 has a respective shape so that the plurality of shells 80 comprises shells 80 that have a variety of shapes.

A first connector 84 is coupled to the pipe 28 distal from the hose connector 34. Each of a plurality of second connectors 86, which are complementary to the first connector 84 is coupled to a respective shell 80 so that the second connector 86 is in fluidic communication with the internal space 82 of the respective shell 80. The second connector 86 is positioned to selectively couple to the first connector 84 to couple the respective shell 80 to the pipe 28.

The second connector 86 and the first connector 84 comprise a quick connector 88. The quick connector 88 allows the user to select a shell 80 that is shaped substantially complementarily to a longitudinal cross-section of a selected elongated article and to quickly connect the shell 80 to the pipe 28. The complementarity of the shell 80 to the longitudinal cross-section allows the user to efficiently clean the selected elongated article by motivating the shell 80 along the length of the selected elongated article.

In use, the cleaning agent is positioned in the reservoir 36. The tube 40 is inserted into the tubular void 56 to fluidically couple the tube 40 to the valve 42. The upper end 38 of the reservoir 36 is threadedly inserted into the recess 54 to couple the reservoir 36 to the handle 44. The hose connector 34 is used to couple the pipe 28 to the hose. The slide switch 66 is selectively slid relative to the handle 44 to regulate the flow of water through the pipe 28 and the rate of addition of the cleaning agent to the water flowing though the valve 42. The water and the cleaning agent exit the holes 26 under pressure to clean the article that is positioned in the channel 16. The bristles 68 dislodge the particles that are adhered to the article as the user motivates the housing 12 along the length of the article.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cleaning assembly comprising:

a housing defining an interior space;

a channel extending from a top to a bottom of said housing defining an inner perimeter and an outer perimeter of said housing;

a plurality of holes positioned in said housing such that each hole extends to said interior space, said plurality of holes extending annularly around said inner perimeter;

a pipe coupled to and extending from said outer perimeter such that said pipe is in fluidic communication with said interior space;

a hose connector coupled to said pipe distal from said housing wherein said hose connector is configured for coupling said pipe to a hose for supplying water through said pipe to said interior space such that the water exits said holes under pressure;

a reservoir coupled to said pipe proximate to said housing;

a tube extending between said reservoir and said pipe wherein a cleaning agent positioned in said reservoir is positioned for entering said pipe such that the water and the cleaning agent exit said holes under pressure for cleaning an article selectively positioned in said channel;

a plurality of nozzles, each said nozzle being coupled to said housing and extending from an associated said hole into said channel wherein said nozzles are configured for increasing a velocity of the water exiting said holes; and said housing comprising a plurality of shells, each said shell defining an internal space, each said shell having a respective shape such that said plurality of shells comprises shells having a variety of shapes;

a first connector coupled to said pipe distal from said hose connector; and a plurality of second connectors complementary to said first connector, each said second connector being coupled to a respective said shell such that said second connector is in fluidic communication with said internal space of said respective said shell wherein said second connector is positioned for selectively coupling to said first connector for coupling said respective said shell to said pipe.

2. The assembly of claim 1, further including said holes being positioned substantially equally distant from said top and said bottom of said housing.

3. The assembly of claim 2, further including a plurality of bristles coupled to said inner perimeter of said housing and extending into said channel wherein said bristles are configured for dislodging particles adhering to the article positioned in said channel.

4. The assembly of claim 3, further including said plurality of bristles comprising:

a set of first fibers positioned between said plurality of holes and said top of said housing; and a set of second fibers positioned between said plurality of holes and said bottom of said housing.

5. The assembly of claim 4, further comprising:

said set of first fibers being positioned in six first groups evenly space around said inner perimeter; and said set of second fibers being positioned in six second groups evenly space around said inner perimeter.

6. The assembly of claim 5, further including said second groups being aligned with said first groups when viewed from said top of said housing.

7. The assembly of claim 1, further comprising:

said pipe extending arcuately from said housing;

a valve coupled to and positioned in said pipe proximate to said housing, said tube having a first end operationally coupled to said valve, said tube having a second end positioned proximate to a lower end of said reservoir;

a handle positioned around and coupled to said pipe wherein said handle is configured for grasping in a hand of the user, said handle being substantially C-shaped such that said pipe is positioned in a medial section of said handle, a first section of said handle extends substantially perpendicularly from said pipe proximate to said valve, and a second section of said handle extends transversely from said pipe proximate to said hose connector;

said reservoir having an upper end, said upper end being externally threaded;

a recess extending into said first section of said handle distal from said pipe, said recess being internally threaded such that said recess is complementary to said upper end of said reservoir wherein said upper end is positioned for threadedly inserting into said recess for coupling said reservoir to said handle;

a tubular void extending from said recess to said valve such that said valve is in fluidic communication with said recess wherein said tube is positioned for inserting into said tubular void for fluidically coupling said tube to said valve; and a controller coupled to said handle, said controller being operationally coupled to said valve wherein said controller is positioned for selectively actuating said valve for regulating a flow of water through said pipe and a rate of addition of the cleaning agent to the water flowing though said valve.

8. The assembly of claim 7, further including said second section being substantially tear-drop shaped.

9. The assembly of claim 7, further including a grip coupled to said medial section of said handle wherein said grip is configured for deterring slippage of the hand of the user grasping said handle.

10. The assembly of claim 7, further including said controller comprising a slide switch wherein said slide switch is configured for being selectively slid relative to said handle by a digit of the hand of the user grasping said handle for regulating the flow of water through said pipe and the rate of addition of the cleaning agent to the water flowing though said valve.

11. The assembly of claim 1, further including said second connector and said first connector comprising a quick connector.

12. A cleaning assembly comprising:

a housing defining an interior space;

a channel extending from a top to a bottom of said housing defining an inner perimeter and an outer perimeter of said housing;

a plurality of holes positioned in said housing such that each hole extends to said interior space, said plurality of holes extending annularly around said inner perimeter;

a pipe coupled to and extending from said outer perimeter such that said pipe is in fluidic communication with said interior space;

a hose connector coupled to said pipe distal from said housing wherein said hose connector is configured for coupling said pipe to a hose for supplying water through said pipe to said interior space such that the water exits said holes under pressure;

a reservoir coupled to said pipe proximate to said housing;

a tube extending between said reservoir and said pipe wherein a cleaning agent positioned in said reservoir is positioned for entering said pipe such that the water and the cleaning agent exit said holes under pressure for cleaning an article selectively positioned in said channel;

an annular pipe positioned in said interior space such that said annular pipe extends around said channel, said annular pipe being fluidically coupled to said pipe and each of said plurality of holes; and a filler positioned around said annular pipe in said interior space such that said housing is substantially solid.

13. A cleaning assembly comprising:

a housing defining an interior space;

a channel extending from a top to a bottom of said housing defining an inner perimeter and an outer perimeter of said housing;

a plurality of holes positioned in said housing such that each hole extends to said interior space, said plurality of holes extending annularly around said inner perimeter, said holes being positioned substantially equally distant from said top and said bottom of said housing;

a pipe coupled to and extending from said outer perimeter such that said pipe is in fluidic communication with said interior space, said pipe extending arcuately from said housing;

an annular pipe positioned in said interior space such that said annular pipe extends around said channel, said annular pipe being fluidically coupled to said pipe and each of said plurality of holes;

a filler positioned around said annular pipe in said interior space such that said housing is substantially solid;

a hose connector coupled to said pipe distal from said housing wherein said hose connector is configured for coupling said pipe to a hose for supplying water through said pipe to said interior space such that the water exits said holes under pressure;

a reservoir coupled to said pipe proximate to said housing, said reservoir having an upper end, said upper end being externally threaded;

a tube extending between said reservoir and said pipe wherein a cleaning agent positioned in said reservoir is positioned for entering said pipe such that the water and the cleaning agent exit said holes under pressure for cleaning an article selectively positioned in said channel, said tube having a first end operationally coupled to said valve, said tube having a second end positioned proximate to a lower end of said reservoir;

a handle positioned around and coupled to said pipe wherein said handle is configured for grasping in a hand of the user, said handle being substantially C-shaped such that said pipe is positioned in a medial section of said handle, a first section of said handle extends substantially perpendicularly from said pipe proximate to said valve, and a second section of said handle extends transversely from said pipe proximate to said hose connector, said second section being substantially tear-drop shaped;

a recess extending into said first section of said handle distal from said pipe, said recess being internally threaded such that said recess is complementary to said upper end of said reservoir wherein said upper end is positioned for threadedly inserting into said recess for coupling said reservoir to said handle;

a tubular void extending from said recess to said valve such that said valve is in fluidic communication with said recess wherein said tube is positioned for inserting into said tubular void for fluidically coupling said tube to said valve;

a grip coupled to said medial section of said handle wherein said grip is configured for deterring slippage of the hand of the user grasping said handle;

a valve coupled to and positioned in said pipe proximate to said housing;

a controller coupled to said handle, said controller being operationally coupled to said valve wherein said controller is positioned for selectively actuating said valve for regulating a flow of water through said pipe and a rate of addition of the cleaning agent to the water flowing though said valve, said controller comprising a slide switch wherein said slide switch is configured for being selectively slid relative to said handle by a digit of the hand of the user grasping said handle for regulating the flow of water through said pipe and the rate of addition of the cleaning agent to the water flowing though said valve;

a plurality of bristles coupled to said inner perimeter of said housing and extending into said channel wherein said bristles are configured for dislodging particles adhering to the article positioned in said channel, said plurality of bristles comprising:

a set of first fibers positioned between said plurality of holes and said top of said housing, said set of first fibers being positioned in six first groups evenly space around said inner perimeter, and a set of second fibers positioned between said plurality of holes and said bottom of said housing, said set of second fibers being positioned in six second groups evenly space around said inner perimeter, said second groups being aligned with said first groups when viewed from said top of said housing; and a plurality of nozzles, each said nozzle being coupled to said housing and extending from an associated said hole into said channel wherein said nozzles are configured for increasing a velocity of the water exiting said holes.

14. The assembly of claim 13, further comprising:

said housing comprising a plurality of shells, each said shell defining an internal space, each said shell having a respective shape such that said plurality of shells comprises shells having a variety of shapes;

a first connector coupled to said pipe distal from said hose connector;

a plurality of second connectors complementary to said first connector, each said second connector being coupled to a respective said shell such that said second connector is in fluidic communication with said internal space of said respective said shell wherein said second connector is positioned for selectively coupling to said first connector for coupling said respective said shell to said pipe, said second connector and said first connector comprising a quick connector.

* * * * *